US005630988A

United States Patent [19]

Stolp

[11] Patent Number: 5,630,988

[45] Date of Patent: *May 20, 1997

[54] PIPETTE TIP MOUNTING AND TRANSFER APPARATUS

[75] Inventor: Philip E. Stolp, Kenwood, Calif.

[73] Assignee: Point Plastics Inc., Petaluma, Calif.

[ * ] Notice: The term of this patent shall not extend beyond the expiration date of Pat. No. 5,487,997.

[21] Appl. No.: 551,457

[22] Filed: Nov. 1, 1995

Related U.S. Application Data

[63] Continuation-in-part of Ser. No. 196,967, Feb. 15, 1994, Pat. No. 5,487,997.

[51] Int. Cl.[6] ..... B01L 3/02

[52] U.S. Cl. ..... 422/100; 422/104; 436/183; 206/443; 206/446; 206/562; 206/563

[58] Field of Search ..... 422/99, 100, 103, 422/104; 636/54, 183; 206/443, 446, 562, 563

[56] References Cited

U.S. PATENT DOCUMENTS

| | | |
|---|---|---|
| 3,375,934 | 4/1968 | Bates . |
| 3,494,201 | 2/1970 | Roach . |
| 3,643,812 | 2/1972 | Mander et al. . |
| 3,940,249 | 2/1976 | McClurg . |
| 4,124,122 | 11/1978 | Emmitt . |
| 4,130,978 | 12/1978 | Cohen . |
| 4,286,637 | 9/1981 | Wilson . |
| 4,349,109 | 9/1982 | Scordata et al. . |
| 4,510,119 | 4/1985 | Hevey . |
| 4,517,851 | 5/1985 | Tice . |
| 4,565,100 | 1/1986 | Malinoff . |
| 4,577,760 | 3/1986 | Rainin et al. . |
| 4,895,650 | 1/1990 | Wang . |
| 4,936,152 | 6/1990 | Aldred . |
| 5,036,989 | 8/1991 | Carilli . |
| 5,057,282 | 10/1991 | Linder . |
| 5,080,232 | 1/1992 | Leoncavallo et al. . |
| 5,128,105 | 7/1992 | Berthold et al. . |
| 5,133,939 | 7/1992 | Mahe . |
| 5,232,669 | 8/1993 | Pardinas . |
| 5,324,482 | 6/1994 | Scaramella et al. . |

FOREIGN PATENT DOCUMENTS

| | | |
|---|---|---|
| 0174706 | 3/1986 | European Pat. Off. . |
| 3924103 | 1/1991 | Germany . |
| WO9308913 | 5/1993 | WIPO . |

OTHER PUBLICATIONS

"Saving the Environment . . . is at the Tip of Your Fingers!", CLP Continental Laboratory Products, pp. 1–3.

"Earth Day Spring Special," CLP Continental Laboratory Products Incorporated, p. 1.

"Saving the Environment is at the Tip of Your Fingers . . . ," esp–Environmentally Sensitive Packaging, for Pipet Tips, CLP Continental Laboratory Products, p. 1 (enlarged).

"Saving the Environment is at the Tip of Your Fingers . . . ," Take Advantage Of the Ultimate in Recyling–Reuse, CLP Continental, pp. 1–2.

Advertisement, "Eppendorf Repeater Pipette," New Eppendorf Envirotips, New Eppendorf Safe–Twist Tubes, New Eppendorf Electronic Pipette; Dealer Bulletin, Brinkmann Instruments, Inc., Mar. 26, 1993, pp. 1–3.

(List continued on next page.)

*Primary Examiner*—Long V. Le

*Attorney, Agent, or Firm*—Majestic, Parsons, Siebert & Hsue

[57] ABSTRACT

A pipette tip assembly is provided which includes one or more pipette tips, a tip support and a tip holder which is movable between a tip-holding and a tip-releasing position. The pipette tip assembly also includes a position-maintaining structure which is adapted to hold the tip holder in the tip-releasing position until the tip holder is selectively moved from that position. The position-maintaining structure thus eliminates or reduces the potential for inadvertent lifting of the tip holder relative to the assembly. The invention thus provides a pipette tip assembly that facilitates secure transport, minimal handling, and convenient and user-controlled operation.

6 Claims, 7 Drawing Sheets

OTHER PUBLICATIONS

"Green–Pak environmentally–friendly pipette tip–rack refill system," Rainin Instrument Co., Inc., pp. 1–4.

"Green–Pak Spacesaver," Rainin Instrument Company, pp. 1–4.

"Elkay ELite 54 Pack, Environmental Lite Packaging," Elkay Labsystems, pp. 1–2.

"Scientific Specialties New EcoPac," Scientific Specialties Incorporated; The innovation doesn't stop, Intermountain Scientific Corporation, p. 1.

Unnumbered page from Continental Laboratory Products catalog.

PIPETTE TIP MOUNTING AND TRANSFER APPARATUS

CROSS-REFERENCE TO RELATED APPLICATION

This is a continuation-in-part of Application Ser. No. 08/196,967, filed on Feb. 15, 1994, now U.S. Pat. No. 5,487,997.

FIELD OF THE INVENTION

The invention relates generally to a pipette tip mounting and transfer apparatus. More particularly, the present invention relates to an assembly comprising one or more pipette tips, a tip support structure and a movable tip holder, in which the tip holder is used to secure the pipette tips during transport, to position the pipette tips relative to the tip support for use and to remove the pipette tips from the tip support. The present invention relates more specifically to such an assembly comprising a structure adapted to hold the tip holder in a position appropriate for removal of the pipette tips from the tip holder.

BACKGROUND OF THE INVENTION

The use of a set of disposable pipette tips and the provision of a carrier therefor is well known. Typically, either a plate carrying a number of pipette tips, usually ninety-six, is provided or a number of such plates, often five, are provided in stacked form as a packaging convenience. In loading the tips for use, a single plate of tips is placed over a support structure (a support rack or another supportive plate of tips) and the tips, variably with or without the single plate, are released into the rack.

In many settings in which pipette tips are used, it is desirable to minimize the user's handling of the tips. However, most prior art tip mounting systems are not fully satisfactory in this regard primarily because in such systems, the tips are disposed somewhat loosely in the carrying plate. Thus, at several points of use, i.e., when the tips and the carrying plate are placed in a package for transport, lifted from such a package after transport using the carrying plate, or placed over a support structure using the carrying plate, the tips are susceptible to becoming displaced from the carrying plate and thus, to requiring manual repositioning in the carrying plate.

Most prior art tip mounting and disposal systems are further unsatisfactory in that they consist of unwieldy tip releasing devices. Particularly problematic are prior art systems in which the loosely disposed tips are automatically released when the carrying plate is placed over the support rack. With such systems, the user is undesirably prevented from controlling the carrying plate between a tip-carrying and a tip-releasing position. This lack of user control results in the tips being prematurely displaced from the carrying plate by a simple jolt or contact. More specifically, premature displacement often occurs during placement over the support structure when the tips are not precisely aligned with tip-receiving apertures of the support. Such precise alignment is extremely difficult to achieve with most existing loose-tip systems. It is therefore desirable to provide a tip mounting and disposal apparatus that is easy to use and allows the user to control the tip-holding and tip-releasing functions thereof.

Prior to the present invention, it has been observed that when a user is removing a tip from a tip holder, the tip holder may be inadvertently lifted relative to a tip support so that it requires repositioning before use is resumed. Such inadvertent lifting may occur, for example, when a tip or a row of tips is being removed at an angle other than perpendicular to the tip support. It has also been observed that when a user is removing a pipette tip assembly from an assembly container or assembly packaging, the tip holder may be inadvertently lifted relative to the tip support. Such inadvertent lifting may occur, for example, by virtue of a container lid catching on a front edge of the tip holder when the container is opened. When the tip holder is so lifted, typically the user must handle the system to reposition the tip holder and any displaced tips. It is therefore desirable to provide a pipette tip mounting and transfer apparatus in which the tip holder may be maintained in a tip-releasing position until it is selectively moved from that position.

SUMMARY OF THE INVENTION

It is an object of the present invention to provide an apparatus for the mounting and transfer of pipette tips in which one or more pipette tips can be rigidly maintained in a pipette tip holder, which is positionable relative to a tip support, movable between a tip-holding and tip-releasing position, and maintainable in the tip-releasing position until selectively moved from that position.

In one aspect of the present invention, a pipette tip assembly is provided which includes one or more pipette tips, a tip support and a tip holder. The pipette tip has an exterior surface which defines a tapered portion which, when the tip is vertically oriented, is inwardly tapered from an upper portion to a lower portion of the tip. Positioned adjacent the upper portion of the tip, but above a lower end of the tip, is an abutment member.

According to this aspect of the present invention, the tip support has at least one support aperture therein for receiving the lower end of the vertically oriented tip. Additionally, the tip support defines a support surface upon which the abutment member of the tip rests when the tip is received in the support aperture.

Furthermore, in this aspect of the present invention, the tip holder is interposed between the abutment member and the upper portion of the tip. The tip holder is constructed to maintain the tip therein and to be movable between an upper position, or tip-holding position, and a lower position, or tip-releasing position. When the tip holder is in the upper position, it serves to rigidly maintain the tip from wobbling in the tip holder. When the tip holder is in the lower position, it allows for the removal of the tip from the tip holder.

These aspects of the present invention are disclosed in application Ser. No. 08/196,967, entitled "Pipette Tip Mounting and Transfer Apparatus and Method" and filed on Feb. 15, 1994 by Philip E. Stolp, now U.S. Pat. No. 5,487,997. In this inventive apparatus, one or more pipette tips are rigidly maintainable in the pipette tip holder, which is capable of being positioned relative to the tip support and is movable between a lower, tip-holding position and an upper, tip-releasing position.

In the present invention, the pipette tip assembly includes a position-maintaining structure which is adapted to hold the tip holder in the lower position until it is selectively moved therefrom. The assembly thus provides a structure which prevents or reduces the potential for inadvertent lifting of the tip holder.

Particular features of the inventive apparatus include the ability to operate the pipette tip assembly between its tip-holding and tip-releasing capacities. The tip holder is used in its tip-holding position to secure the pipette tips during tip transport in a package, tip transfer from the package or other location to the tip support, tip placement relative to the tip support, and tip removal from the tip support for transport, repositioning, disposal or other purposes. Once the pipette tips have been placed relative to the tip support, the tip holder is moved to its tip-releasing position to release the tips in the tip support such that they can be disengaged from the assembly for use. In the inventive apparatus, the tip holder can be held in the lower, tip-releasing position until the user selectively moves it out of that position. When the tip holder is so held, inadvertent lifting of the tip holder relative to the apparatus is eliminated or reduced.

The pipette tip assembly of the present invention eliminates the significant handling problems of most existing tip mounting and disposal systems. Particularly, the assembly of the present invention allows the user to control the tip-holding and tip-releasing functions of the assembly, without the use of complicated or unmanageable devices, and to remove the removable components of the assembly in a convenient and clean manner.

Additional objects, advantages and features of the various aspects of the present invention will become apparent from the following description of its preferred embodiments, which description should be taken in conjunction with the accompanying drawings.

BRIEF DESCRIPTION OF THE DRAWINGS

FIG. 1A further illustrates, in cut-away, tapered apertures of the tip holder and a raised edge of the tip holder, according to embodiments of the present invention.

FIG. 3A illustrates, in cut-away, the assembly including a plurality of pipette tips disposed in a tip support, a tip holder in a tip-holding position around the pipette tips and a cover adjacent a raised edge of the tip holder.

FIG. 3B schematically illustrates, in partial cut-away, the assembly upon movement of the cover in a direction toward the tip support and consequent movement of the tip holder to a tip-releasing position.

FIG. 3C illustrates the assembly without the cover in which the tip holder is in the tip-releasing position.

FIG. 3D schematically illustrates the assembly upon movement of the tip holder in a direction away from the tip support and consequent movement of the tip holder to a tip-holding position.

FIG. 4A illustrates the assembly in which a tip holder is in a tip-holding position, according to an embodiment of the present invention.

FIG. 4B illustrates the assembly in which the tip holder of FIG. 4A is held in a tip-releasing position.

FIG. 4C illustrates the assembly in which a tip holder is in a tip-holding position, according to another embodiment of the present invention.

FIG. 4D illustrates the assembly in which the tip holder of FIG. 4C is held in a tip-releasing position.

DESCRIPTION OF PREFERRED EMBODIMENTS

Figure 1A:
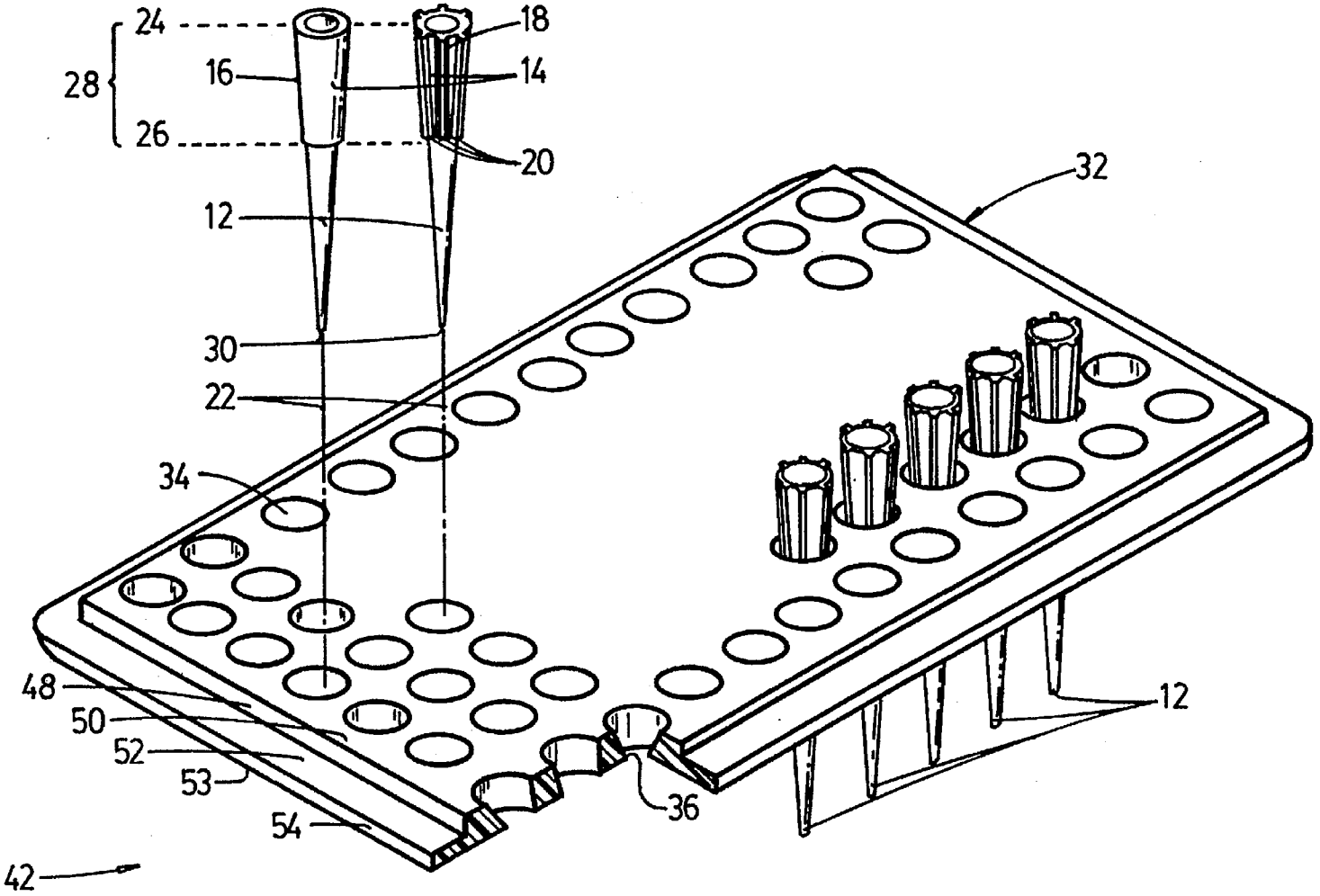
FIG. 1A illustrates an exploded view of a plurality of pipette tips and a tip holder therefor, including: one pipette tip shown above the tip holder, according to an embodiment of the present invention; another pipette tip shown above the tip holder, according to an alternative embodiment of the present invention; and five pipette tips, according to the alternative embodiment, shown disposed within the tip holder.

FIG. 1A illustrates a pipette tip assembly 10 which includes at least one longitudinally extending pipette tip 12. The pipette tip 12 has an exterior surface 14 defining a substantially tapered portion 28. The tapered portion 28 is inwardly tapered from an upper plane 24 towards a lower plane 26, both planes being transverse to a longitudinal axis 22 of the tip 12 when the tip 12 is vertically oriented.

Below the upper plane 24 of the tapered portion 28 and above a lower end 30 of the tip, lies an abutment member 16 or 18. As shown in FIG. 1A, abutment member 16 or 18 may be a substantially smooth-surfaced abutment member 16, or alternatively, a ribbed abutment member 18, having a plurality of ribs 20. In the latter embodiment, ribs 20 are preferably substantially evenly spaced and longitudinally oriented on the exterior surface 14 of the tip 12. While the abutment member 16 or 18 is shown in FIG. 1A as having a substantially smooth surface 16 or a plurality of ribs 20, other shapes are contemplated.

As shown in FIG. 1A, the pipette tip assembly 10 also includes a tip holder 32 which is interposable between the abutment member 16 or 18 and the upper plane 24 of the tapered portion 28 of the tip 12. The tip holder 32 has a construction sufficient to maintain the tip therein. Additionally, tip holder 32 is movable between an upper position 38 and a lower position 40, as shown in FIGS. 2, 3A–3D and 4A–4D. When tip holder 32 is in the upper position 38, tip holder 32 rigidly maintains tip 12 from wobble in tip holder 32. When tip holder 32 is in the lower position 40, tip 12 is removable from tip holder 32 and/or from a tip support 56 described below.

Figure 2:
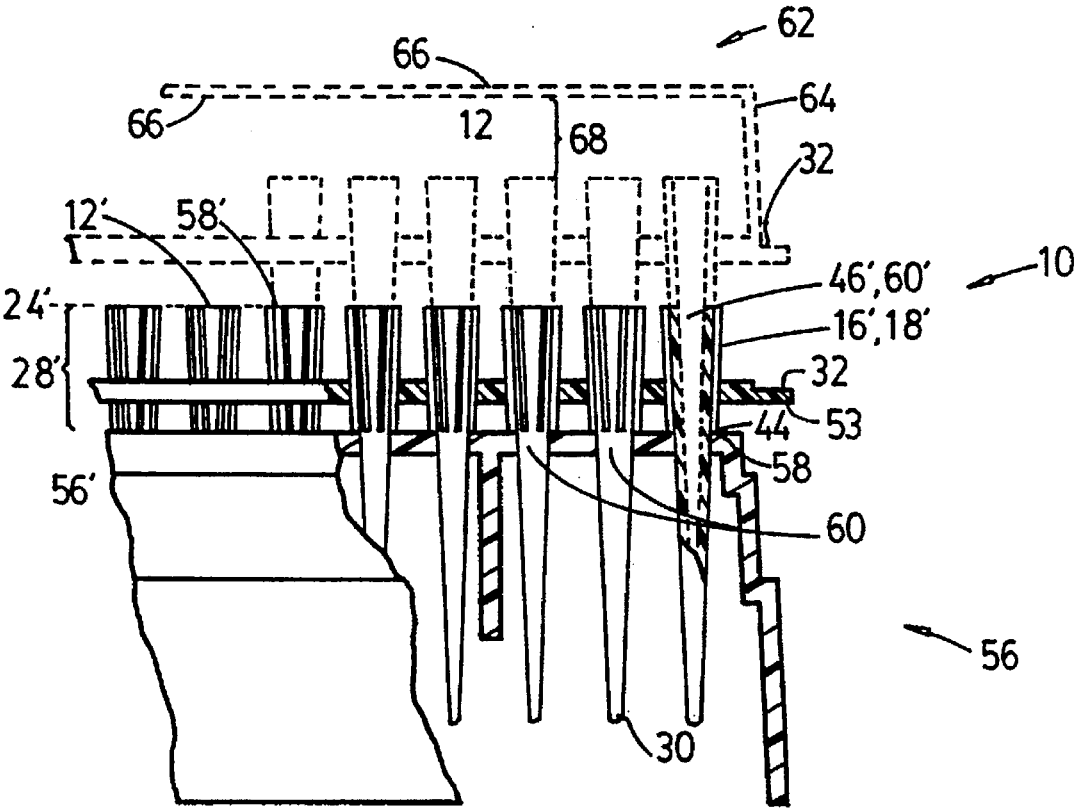
FIG. 2 illustrates an assembly according to embodiments of the present invention, including: a tip support with a solid-lined plurality of pipette tips disposed therein; a solid-lined tip holder in a tip-holding position around the solid-lined pipette tips; a phantom-lined plurality of pipette tips disposed in the solid-lined pipette tips; a phantom-lined tip holder in a tip-holding position around the phantom-lined pipette tips; and a phantom-lined cover adjacent a raised edge of the phantom-lined tip holder.

The pipette tip assembly 10 may include a tip support 56, as shown in FIGS. 2, 3A–3D and 4A–4D. As shown in FIG. 2, tip support 56 defines a support surface 58 and has at least one support aperture 60 therein. The support aperture 60 is adapted to receive the lower end 30 of tip 12 such that abutment member 16 or 18 rests upon support surface 58 when tip 12 is vertically oriented.

Figure 1B:
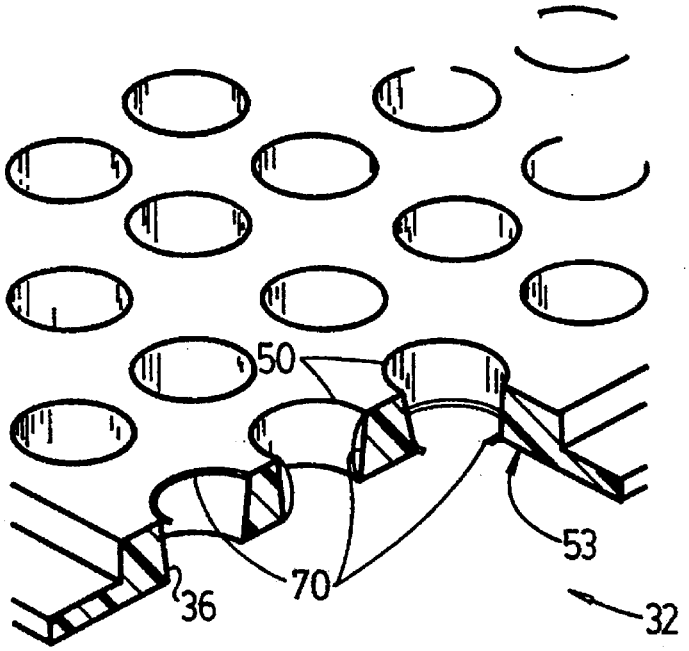
FIG. 1B illustrates, in cut-away, an enlarged view of a tip holder including tip-securing members in the tapered apertures of the tip holder, according to alternative embodiments of the present invention.

Preferably, tip holder 32 of assembly 10 has at least one holder aperture 34 for receiving tip 12. According to a preferred embodiment of the present invention, holder aperture 34 has a taper 36 which substantially corresponds to at least a portion of the taper of tapered portion 28 of tip 12. This taper 36 is shown in FIGS. 1A and 1B.

As illustrated in FIG. 2, holder aperture 34 is of sufficient diameter so that when tip holder 32 is in upper position 38, a lower portion of the abutment member 16 or 18 extends beyond the holder aperture 34, i.e., past an under surface 53 of tip holder 34. According to a preferred embodiment of the present invention, holder aperture 34 rigidly maintains the tip 12 therein when tip holder 32 is in upper position 38, such that tip holder 32 and tip 12 form a substantially unified tip transport structure 42.

According to one aspect of the present invention, when tip holder 32 is in upper position 38, it serves as a load member for aligning tip 12 with, and loading tip 12 onto, tip support 56. The resulting loaded assembly 10 is shown in FIGS. 2, 3A–3C and 4A–4D. In another aspect of the present invention, when tip holder 32 is in upper position 38, it acts as a removal member for removing tip 12 from tip support 56, as shown in FIG. 3D. According to yet another aspect of the present invention, shown in FIGS. 3B, 3C, 4B and 4D, when tip holder 32 is in lower position 40, holder aperture 34 surrounds tip 12 so that tip holder 32 substantially stabilizes tip 12 from transverse movement, with respect to longitudinal axis 22, in tip support 56.

As shown in assembly 10 of FIG. 2, abutment member 16 or 18 has a bearing surface 44 at its lower end. At the bearing surface 44, the outer diameter of the abutment member 16 or 18 is substantially greater than the inner diameter of the support aperture 60 at support surface 58. Preferably, this outer diameter of abutment member 16 or 18 at bearing surface 44 is also substantially less than the inner diameter of the holder aperture 34 at its most tapered portion, i.e., at under surface 53. While shapes other than smooth-surfaced or ribbed shapes are possible for the abutment member, the abutment member preferably has the above-mentioned dimensional characteristics.

According to an alternative embodiment of the present invention, as shown in FIG. 2, pipette tip assembly 10 may comprise a group of stacked pipette tips. In the description of this stacked embodiment, items represented by numerals followed by a prime indication (') refer to the items represented by unprimed numerals throughout this description, but directed to the solid-lined, central portion of the stacked assembly 10 of FIG. 2.

In this embodiment, stacked pipette tip assembly 10 includes at least one other tip support 56' in addition to tip support 56 described above. This other tip support 56' includes at least one other tip 12'. Thus, the support surface 58' of other tip support 56' is actually an upper end of other tip 12' at the upper plane 24' of its tapered portion 28'. Further, the support aperture 60' of other tip support 56' is an opening 46' in the upper end of other tip 12'. Preferably, in this embodiment, the pipette tip assembly 10 further includes at least one other tip holder 32'. Other tip holder 32' has a construction sufficient to maintain other tip 12' therein and is interposable between the abutment member 16' or 18' of other tip 12' and upper plane 24' of tapered portion 28' of other tip 12'. In this manner, other tip support 56' serves to support at least one pipette tip 12 therein. In the stacked embodiment of the present invention, other tip support 56', other tip 12' and other tip holder 32' have all of the attributes of their unprimed counterparts previously and hereinafter described.

In the stacked embodiment described above, the tips may be removed from the assembly for use and returned thereafter to the uppermost tip holder in the assembly. For tip removal, at least one of the tip holders is lifted away from an underlying tip support, thereby returning to its tip-holding position. In this manner, compact removal of multiple tips and one or more tip holders is conveniently achieved with minimal effort and no unnecessary handling of the secured pipette tips themselves. If the removal of the tips is for disposal purposes, such compact removal allows for minimal use of safety materials for the disposal of biological or other environmentally hazardous materials. Thus, the stacked embodiment of the present invention allows the user to remove the removable components of the assembly in a convenient and clean manner and to discard the disposable components of the assembly in a safe and environmentally sound manner.

According to a preferred embodiment of the present invention, tip holder 32 has a shape-retaining member 48 for retaining a shape of tip holder 32 when tip holder 32 has tip 12 rigidly maintained therein. As shown in FIG. 1A, shape-retaining member 48 may include a raised edge defining a shape-retaining structure between an upper surface 50 and a lower surface 52 of the tip holder 32. This raised edge may be disposed adjacent a perimeter 54 of tip holder 32, as shown in FIG. 1A. In such an embodiment, the shape-retaining member 48 prevents tip holder 32 from being warped when pipette tips 12 are pressed into the holder apertures 34 of tip holder 32° While shape-retaining member 48 has been described in terms of a raised edge, other configurations are contemplated.

Figure 3A:
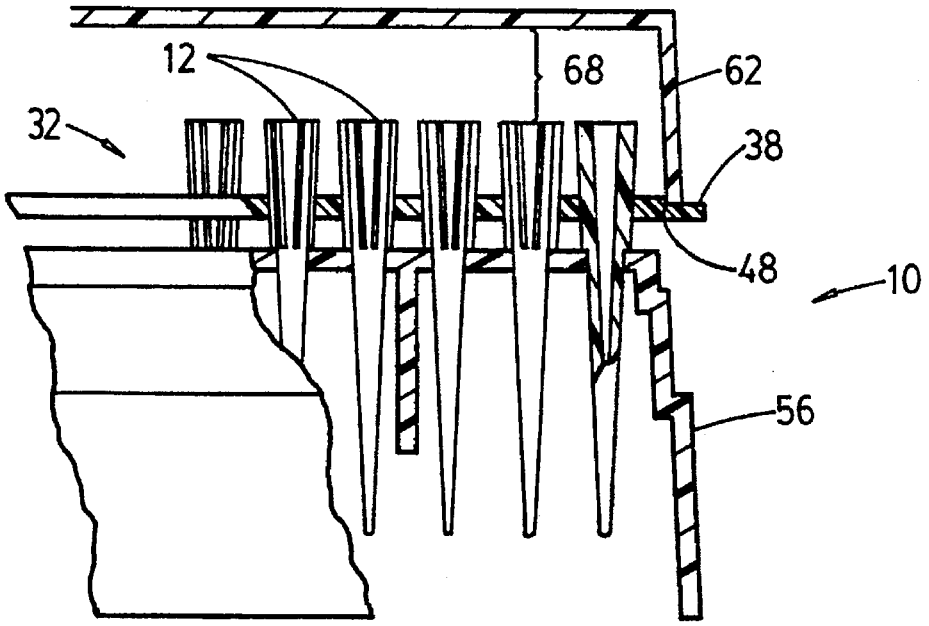
FIGS. 3A–3D illustrate various configurations of an assembly of the present invention.
Figure 3B:
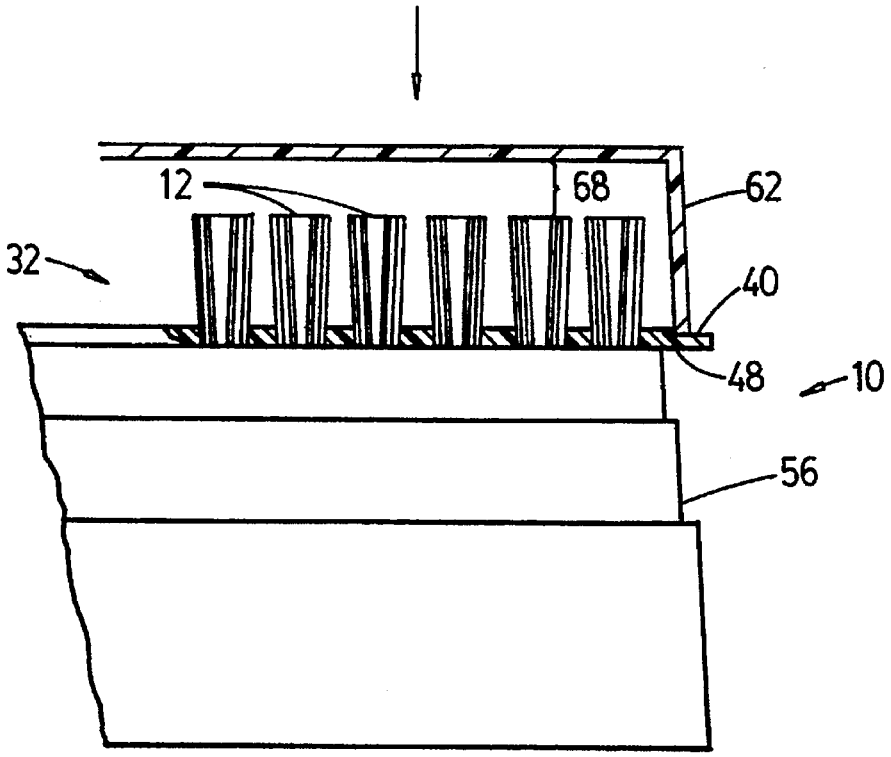
Figure 3C:
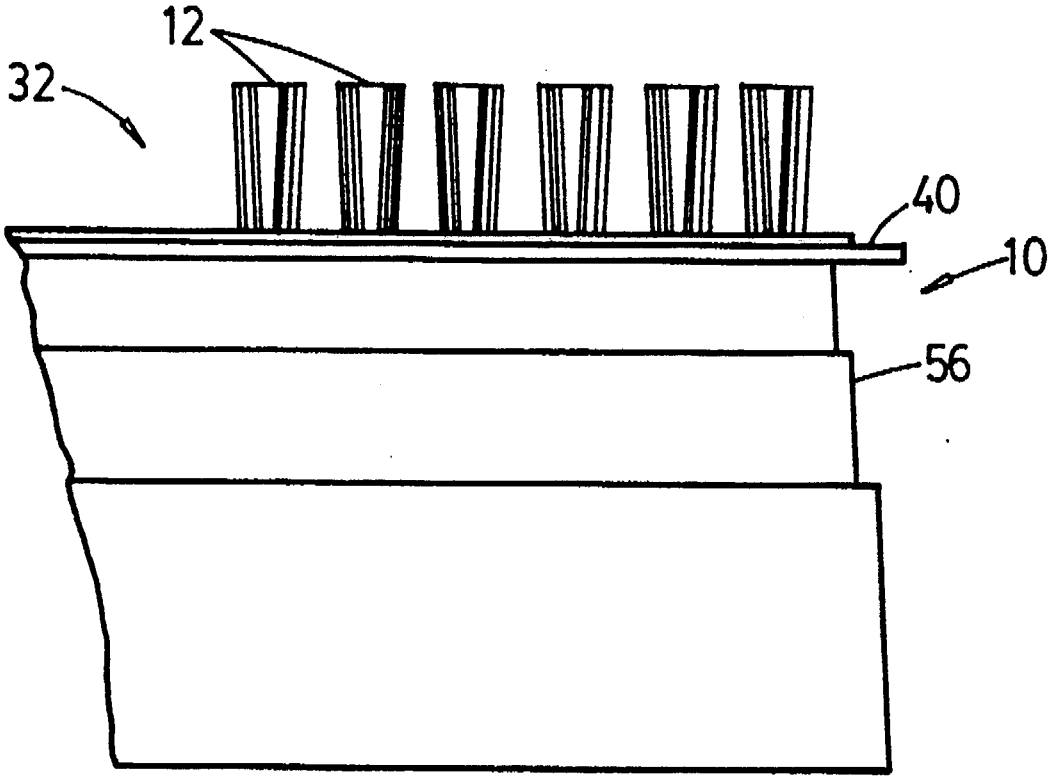
Figure 3D:
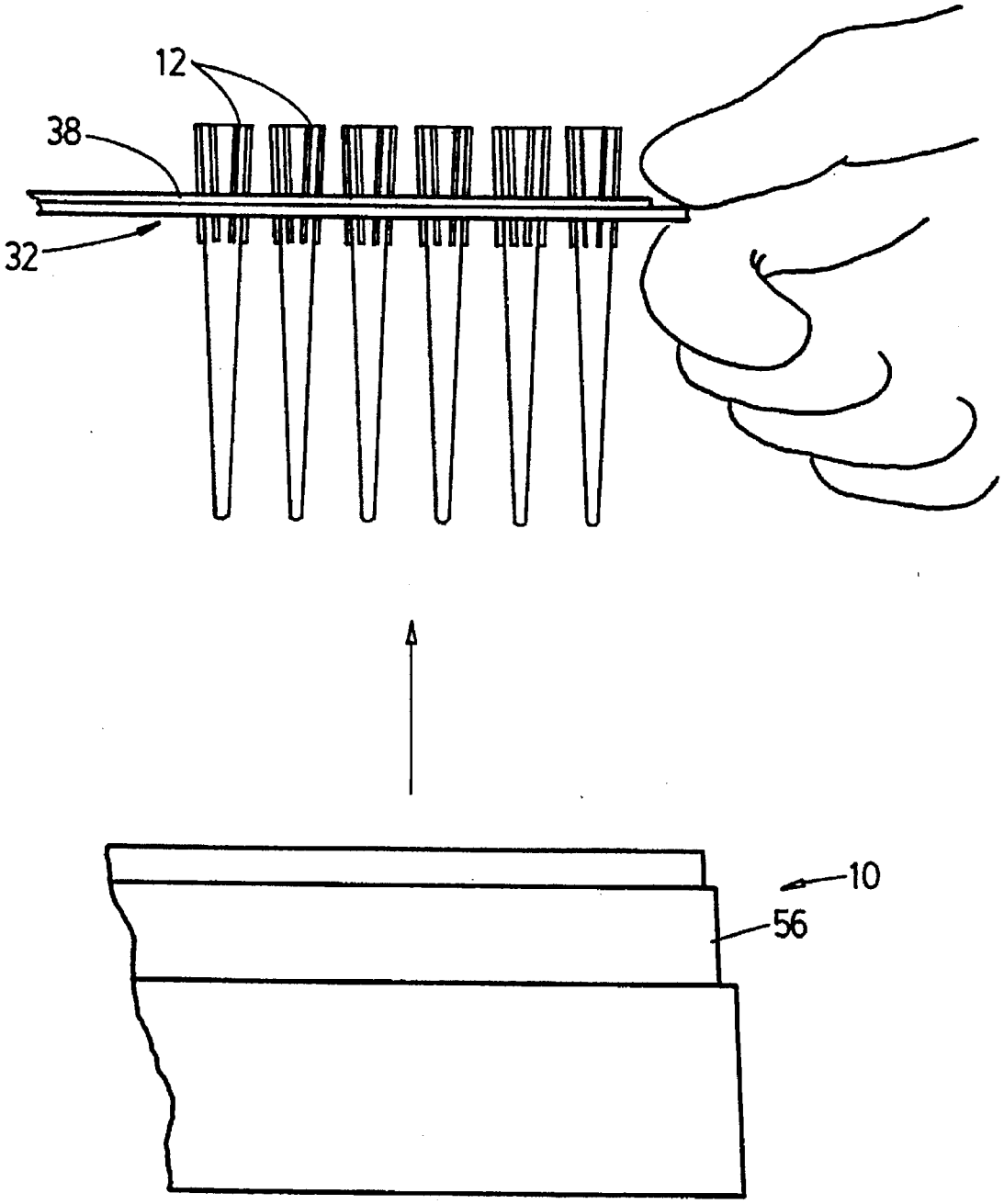

As shown in FIGS. 2, 3A and 3B, the pipette tip assembly 10 may further comprise a cover 62. The cover 62 has a substantially extended portion 64 and a substantially recessed portion 66. Extended portion 64 is formed to conform substantially to a shape of the tip holder 32 adjacent its perimeter 54. Additionally, recessed portion 66 is formed to provide substantially a clearance 68 between tip 12 and cover 62 when cover 62 is positioned over tip holder 32.

As is schematically shown in FIGS. 3A and 3B, cover 62 preferably acts as a positioning member for moving tip holder 32 from upper position 38 to lower position 40. As further shown in FIGS. 3A and 3B, extended portion 64 of cover 62 is formed to conform substantially to the shape of shape-retaining member 48. When shape-retaining member 48 is in the form of a raised edge, as previously described, the cover 62 will conform substantially to the raised edge.

In one embodiment of the present invention, pipette tip assembly 10 includes one longitudinally extending pipette tip 12, as described herein, abutment member 16 or 18 and a tip holder 32 which is interposable between abutment member 16 or 18 and upper plane 24 of tapered portion 28 of tip 12, as shown in FIG. 1A. The tip holder 32 has at least one holder aperture 34 for receiving tip 12. The holder aperture 34 has a taper 36 substantially corresponding to at least a portion of the tapered portion 28 of the tip 12.

Additionally, as previously described, the tip holder 32 of this embodiment is moveable between an upper position 38 and a lower position 40. The holder aperture 34 is of sufficient diameter such that when the tip holder 32 is in the upper position 38, a lower portion of the abutment member 16 or 18 extends beyond the holder aperture 34. Preferably, the holder aperture 34 rigidly maintains the tip therein when the tip holder 32 is in the upper position 38 such that the tip holder 32 and the tip 12 form a substantially unified tip transport structure 42.

According to one aspect of the present invention, the holder aperture 34 may include a tip-securing member 70 adjacent to the taper 36 of the holder aperture 34, as depicted in FIG. 1B. Tip-securing member 70 is adapted to dig into tip 12 to ensure that tip 12 is held securely in holder aperture 34. FIG. 1B shows several embodiments of tip-securing member 70. Particularly, tip-securing member 70 may be a ring projecting inwardly from the taper 36 of the holder aperture 34. As shown in FIG. 1B, the ring may be positioned adjacent upper surface 50 of tip holder 32, intermediate upper surface 50 and under surface 53 of tip holder 32, or adjacent under surface 53 of tip holder 32. Other positionings of tip-securing member 70 relative to taper 36 are contemplated. Further, while tip-securing member 70 has been described as a ring, other shapes, including a barbed ring, are contemplated.

The present invention is useful for loading at least one pipette tip 12 into a pipette assembly 10 and for unloading the tip from the assembly. For loading, the tip 12 is placed in tip holder 32, preferably in a holder aperture 34 which receives the tip. For secure tip holding, this holder aperture may have a taper which substantially corresponds to at least a portion of the tapered portion 28 of the tip. When the tip is placed in the tip holder in this manner, a lower portion of the abutment member 16 or 18 extends beyond the tip holder.

The tip is then pressured into the tip holder such that the tip is rigidly maintained within the tip holder. As the tip is pressured into the tip holder, the tip holder preferably has a shape-retaining member 48 for retaining the shape of the tip holder when pressure is applied to the tip placed therein. Preferably, when the tip is so placed in the tip holder, the tip and the tip holder form a substantially unified tip transport structure 42. For such secure tip holding, the tip holder may include a tapered holder aperture 34 which has a tip-securing member 70 adjacent to and projecting inwardly from the taper 36 of the holder aperture.

The tip holder is then positioned over the tip support 56 such that the support aperture 60 receives the lower end 30 of the tip and the lower portion of the abutment 16 or 18 rests on the support surface 58 of the tip support. The tip holder is then movable between the upper position 38 and the lower position 40. Preferably, the tip holder is so moved using the cover 62. The cover is placed over the tip holder such that the extended portion 64 contacts the tip holder. The cover is then pressured in a direction towards the tip holder such that the tip holder is moved from the upper position to the lower position.

When the cover is lifted away from the tip holder, or the tip holder is otherwise accessible, the tip may be unloaded. For unloading, the tip holder is lifted in a direction away from the tip support such that the tip 12 is carried by the tip holder away from the tip support.

As examples only, and not to limit the invention, dimensions of a particularly preferred embodiment will now be described. The lower surface 52 and under surface 53 of the tip holder 32 may have dimensions of approximately 4,750 inches by 2.335 inches. The upper surface 50 of the tip holder 32 preferably may have dimensions of approximately 4.380 inches by 3,010 inches. The lower surface 52 and the upper surface 50 of the tip holder 12 may be distanced by about 0.075 inches; thus, the shape-retaining member 48 of the tip holder 32, which is positioned between these two surfaces, preferably may be about 0.075 inches in height. Additionally, the under surface 53 and the upper surface 52 of the tip holder 32 may be distanced by about 0.125 inches.

In this preferred embodiment, adjacent holder apertures 34 are preferably spaced from one another by a distance of about 0.352 inches between the centers thereof. Preferably, the holder apertures 34 are tapered from an outer diameter of approximately 0.3284 inches at the upper surface 50 of the tip holder 32 to an outer diameter of approximately 0.3152 inches at the under surface 53 of the tip holder 32. Additionally, the holder apertures 34 are tapered from an inner diameter of approximately 0.1292 inches at the upper surface 50 of the tip holder 32 to an inner diameter of approximately 0.1226 inches at the under surface 53 of the tip holder 32, which corresponds to approximately a 3° taper in taper 36.

In an alternative embodiment of particularly preferred dimensions, the lower surface 52 and under surface 53 of the tip holder 32 has the above-described preferred dimensions, while the upper surface 50 of the tip holder 32 may have alternative dimensions of approximately 4,320 inches by 2.900 inches. In either the preferred or the alternative embodiment, a rib 20 of the ribbed abutment member 18 preferably has a thickness of 0.030 inches.

Preferred materials of construction for the pipette tip assembly 10 include polymeric thermoplastic materials. By way of example, and not to limit the invention, pipette tip 12, tip holder 32, tip support 56 and cover 62 may be composed of a pressure-resistant durable plastic, such as molded polypropylene. In a particularly preferred embodiment, pipette tip 12 is composed of polypropylene. The construction materials for pipette tip assembly 10 may be translucent or opaque and may be colored.

As described herein, the present invention provides a pipette tip assembly 10 in which pipette tips 12 can be maintained from undesired movement or wobble within pipette tip holder 32, so that pipette tips 12 can be easily transported, aligned with, loaded onto, or stacked onto tip support 56, and removed from tip support 56 for transport, repositioning, disposal or other purposes. Further, the present invention provides an assembly 10 in which the user can control the movement of pipette tip holder 32 between a tip-holding position 38 and a tip-releasing position 40. The present invention additionally provides a simple tip-releasing device in the form of multi-purpose cover 62 which further protects pipette tips 12 and assembly 10 from contamination. Further attributes and advantages of the pipette tip assembly 10 are readily apparent from this description.

As additionally described herein, the present invention provides a pipette tip assembly 10 in which one or more pipette tips 12 are pressed into a pipette tip holder 32 and rigidly maintained therein, the pressed tips and the tip holder are positioned relative to a tip support 56, and the tip holder is moved between tip-holding and tip-releasing positions 38 and 40 according to the user's particular requirement. Additionally, the present invention provides a multi-purpose cover 62 as a simple tip-releasing device which moves the tip holder from the tip-holding position to the tip-releasing position. Additional attributes and advantages of the invention are readily from this description.

According to the present invention, as depicted in FIGS. 4A–4D, the pipette tip assembly 10 further includes a position-maintaining structure 110. The position-maintaining structure is adapted to hold the tip holder 32 in the lower, tip-releasing position 40 until the tip holder is selectively moved from the lower position. In this manner, the potential for inadvertent displacement of tip holder 32 is eliminated or reduced.

It is preferred that the positioning maintaining structure 100 not cause interference with any of the holder apertures 34 or support apertures 60 of the assembly 10. For example, preferably the position-maintaining structure 100 is not positioned such that any of the apertures which receive a pipette tip therein is blocked from use which would reduce the throughput of the assembly 10.

Preferably, the position-maintaining structure 110 includes a peg 110 or 124 and an aperture 114 or 120 which is adapted to receive the peg therein. The peg 110 or 124 is disposed on either one of the tip holder 32 or the tip support 56, while the aperture 114 or 120 is disposed in the other one of the tip holder 32 or the tip support 56.

Figure 4A:
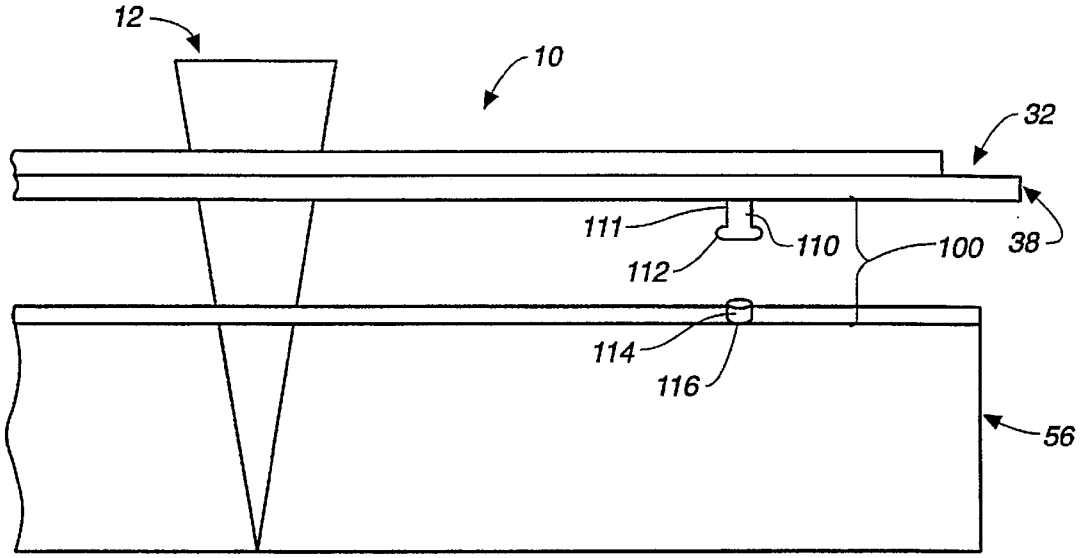
FIGS. 4A–4D illustrate various configurations of an assembly of the present invention.
Figure 4B:
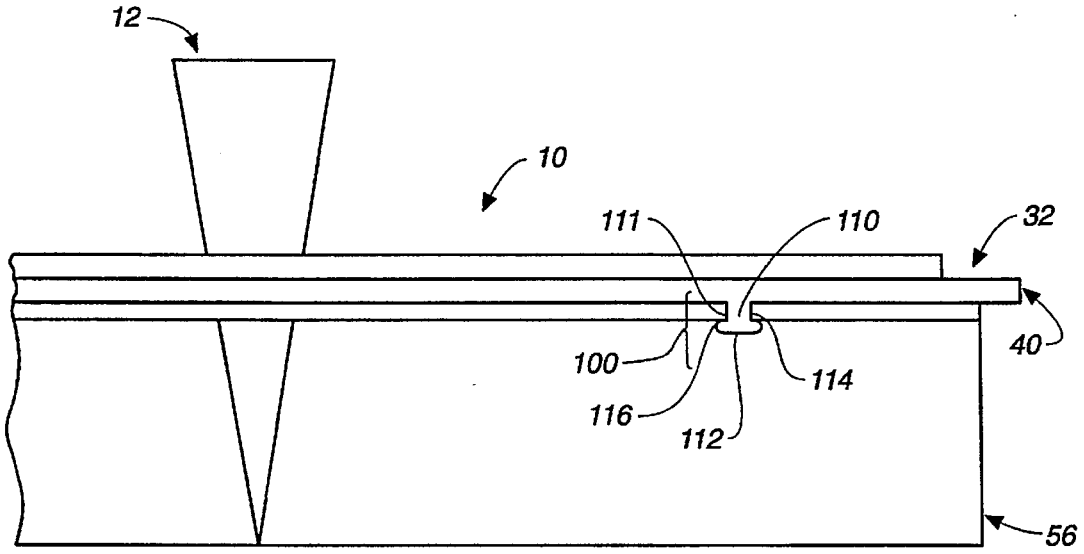

By way of example, the peg 110 shown in FIGS. 4A and 4B is disposed on the tip holder 32, while aperture 114 is disposed in the tip support 56. In this configuration, the peg 110 extends from the tip holder 32 towards the aperture 114 in the tip support.

Figure 4C:
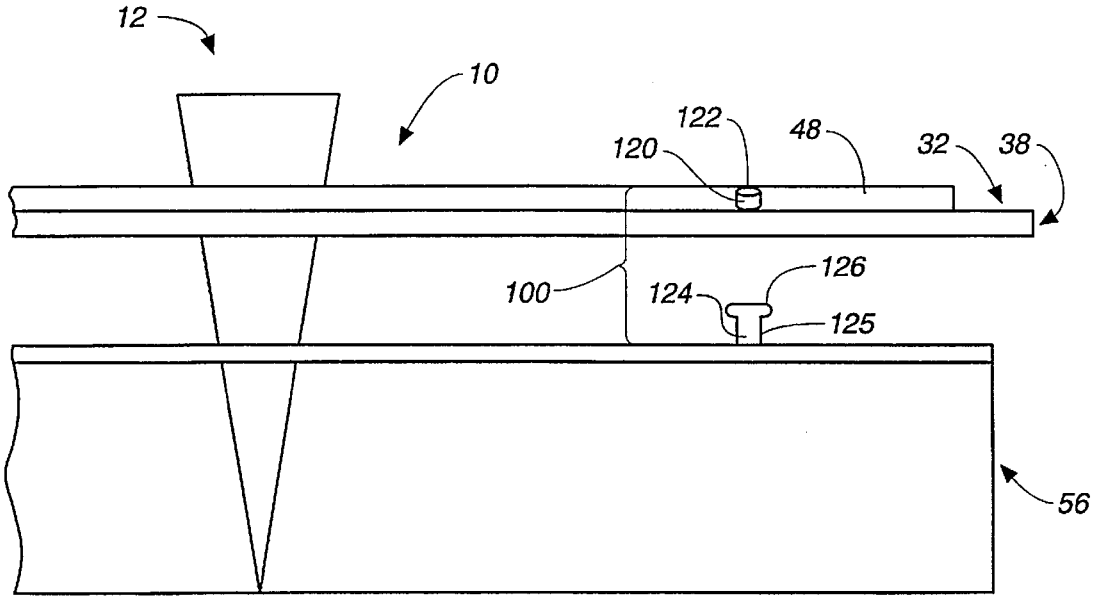
Figure 4D:
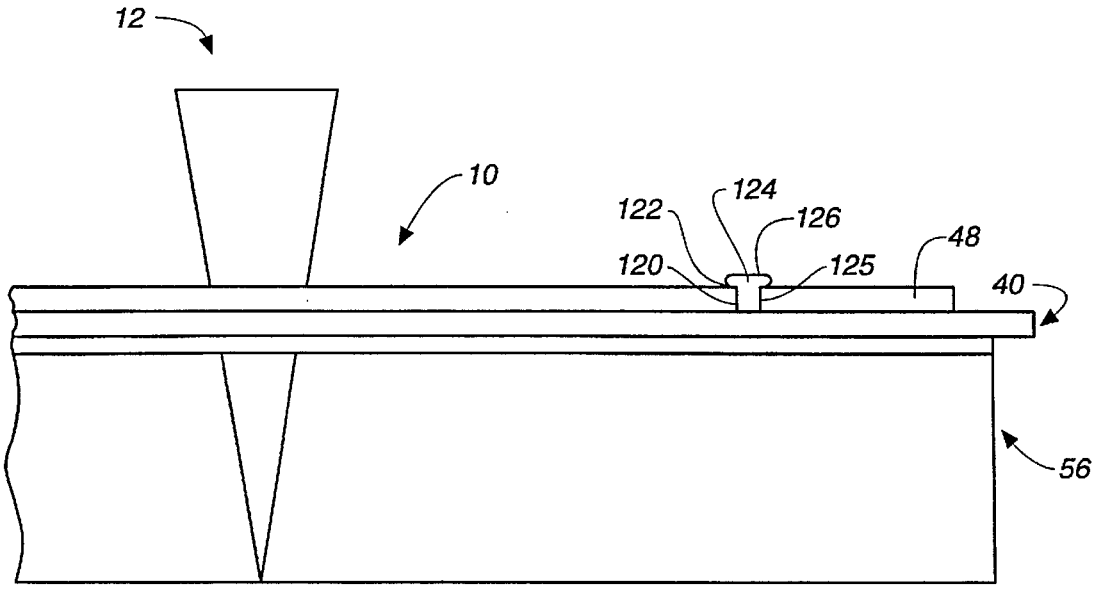

In the example shown in FIGS. 4C and 4D, the peg 124 is disposed on the tip support 56, while the aperture 120 is disposed in the tip holder 32. In this configuration, the peg 124 extends from the tip support 56 towards the aperture 120 in the tip holder 32. Further, in this latter configuration, the aperture 120 may extend through the shape-retaining member 48 provided it is accessible to the peg 124 through the lower surface 52 of the tip holder 32, as shown in FIGS. 4C and 4D, or may extend through the full thickness of the tip holder 32.

Preferably, the peg 110 or 124 frictionally fits in the aperture 114 or 120. Thus, the diameter of the aperture should be about equal to or slightly less than that of the shaft portion 111 or 125 of the peg.

It is also preferable for the peg to have a lip portion 112 or 126 extending from the shaft portion 111 or 125 to the end of the peg which is remote from either the tip holder 32 or the tip support 56 to which the peg is attached. In this embodiment, the lip portion 112 or 126 has a diameter which is greater than that of the aperture at the surface 116 or 122 thereof. In operation, when the peg is received in the aperture, the lip portion 112 or 126 extends beyond this surface 116 or 122 of the aperture. In this embodiment, the peg is preferably dimensioned such that the lip portion 112 or 126 contacts the surface 116 or 122 of the aperture when the peg is so received therein.

According to the present invention, the tip support or the tip holder in which the aperture is disposed is preferably made of a material of a composition sufficient, such as in pliability and resiliency, for accommodating the peg or the lip portion thereof. In this preferred embodiment, the aperture is adapted to receive the peg or lip portion thereof in a secure, friction-fit manner. Furthermore, this secure friction-fit is achievable in a convenient and user-friendly manner.

In a preferred method of using the assembly 10, the tip holder 32, which holds at least one vertically oriented pipette tip 12, is initially in the upper position 38, as shown in FIGS. 4A and 4C. The tip holder 32 is positioned in desired relation to the tip support 56, such that the lower end 30 of the tip 12 is received in the tip support and the lower end of the abutment member 16 or 18 rests upon the support surface 58. The tip holder 32 is then moved from the upper position 38 to the lower position 40, as shown in FIGS. 4B and 4D, such that the tip 12 is removable from the tip holder. As a preventive measure against inadvertent lifting of the tip holder 32 relative to the tip support 56 upon tip removal, the position-maintaining structure 100, described above, is employed to hold the tip holder in the lower position 40 until the tip holder is selectively moved from that position. Preferably, the tip holder 32 is pressed downwardly, towards the tip support 56, such that peg 110 or 124 is received in a friction-fit manner in aperture 114 or 120.

When the peg is so received in the aperture, according to any of the above-described embodiments, the assembly 10 is secured in the position-maintaining configuration. It is in this configuration that the tip holder 32 is held in its lower position 40, until it is selectively moved out of that position. Further, it is in this configuration that potential for inadvertent lifting of the tip holder 32 relative to the tip support 56 is eliminated or reduced. As such lifting is avoided, user handling of the assembly 10, such as for repositioning the tip holder 32 within the assembly, is also eliminated or reduced. Further attributes and advantages of the pipette tip assembly 10 are readily apparent from this description.

It is to be understood that while the invention has been described above in conjunction with preferred specific embodiments, the description is intended to illustrate and not to limit the scope of the invention, which is defined by the scope of the appended claims.

It is claim:

1. A pipette tip assembly, comprising:

at least one longitudinally extending pipette tip, said tip defining a tapered portion which comprises a tapered abutment member inwardly tapered from an upper plane towards a lower plane and having a lower end disposed adjacent to the lower plane, wherein the upper and lower planes are transverse to a longitudinal axis of the tip when the tip is vertically oriented and wherein the lower plane is disposed above a lower end of the tip;

a tip support defining a support surface and adapted to receive the lower end of the tip with the lower end of the abutment member resting upon the support surface when the tip is vertically oriented;

a tip holder, having at least one aperture in which the tip is removably disposed, the tip holder disposed between the upper plane and the support surface, the tip holder selectively movable from an upper position relative to both the tip and the tip support, to a lower position in contact with the support surface, when in the upper position, the tip holder held above the support surface and rigidly maintaining the tip from wobble in the tip holder until selectively moved from the upper position, when in the lower position, the tip being removable from the tip holder; and, a position-maintaining structure adapted to hold said tip holder in the lower position until said tip holder is selectively moved from the lower position.

2. The assembly of claim 1 wherein the position-maintaining structure includes a peg and an aperture adapted to receive the peg therein, the peg disposed on one of said tip holder and said tip support and the aperture disposed in another one of said tip holder and said tip support.

3. The assembly of claim 2 wherein the peg frictionally fits in the aperture.

4. The assembly of claim 2 wherein the peg has a tip portion which extends beyond a surface of the aperture when the peg is received therein and has a diameter greater than that of the aperture at the surface thereof.

5. The assembly of claim 2 wherein the peg extends from the tip support towards the aperture in the tip holder.

6. The assembly of claim 2 wherein the peg extends from the tip holder towards the aperture in the tip support.

* * * * *

UNITED STATES PATENT AND TRADEMARK OFFICE

CERTIFICATE OF CORRECTION

PATENT NO. : 5,630,988

DATED : May 20, 1997

INVENTOR(S) : Philip E. Stolp

It is certified that error appears in the above-indentified patent and that said Letters Patent is hereby corrected as shown below:

In Column 10, at Line 55 in Claim 4 replace:

" 4. The assembly of claim 2 wherein the peg has a tip"

with

-- 4. The assembly of claim 2 wherein the peg has a lip--

Signed and Sealed this

Fourth Day of November, 1997

Bruce Lehman

*Attest:*

BRUCE LEHMAN

*Attesting Officer*

*Commissioner of Patents and Trademarks*